US006852043B2

(12) United States Patent
Sullivan et al.

(10) Patent No.: US 6,852,043 B2
(45) Date of Patent: Feb. 8, 2005

(54) GOLF BALL

(75) Inventors: Michael J. Sullivan, Barrington, RI (US); Derek A. Ladd, Fairhaven, MA (US); Antonio U. DeSimas, East Providence, RI (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 10/317,958

(22) Filed: Dec. 12, 2002

(65) Prior Publication Data

US 2004/0116211 A1 Jun. 17, 2004

(51) Int. Cl.[7] ..... A63B 37/06
(52) U.S. Cl. ..... 473/374
(58) Field of Search ..... 473/373–374

(56) References Cited

U.S. PATENT DOCUMENTS

| | | | | |
|---|---|---|---|---|
| 5,567,772 A | | 10/1996 | Hagman et al. | 525/221 |
| 5,803,831 A | | 9/1998 | Sullivan et al. | 473/374 |
| 5,885,172 A | | 3/1999 | Hebert et al. | 473/354 |
| 6,015,356 A | * | 1/2000 | Sullivan et al. | 473/373 |
| 6,117,024 A | * | 9/2000 | Dewanjee | 473/351 |
| 6,132,324 A | | 10/2000 | Hebert et al. | 473/378 |
| 6,210,293 B1 | | 4/2001 | Sullivan | 473/374 |
| 2001/0014632 A1 | | 8/2001 | Iwami et al. | |
| 2001/0018373 A1 | | 8/2001 | Moriyama et al. | |
| 2001/0031670 A1 | | 10/2001 | Iwami et al. | |
| 2001/0041631 A1 | | 11/2001 | Kato et al. | |

FOREIGN PATENT DOCUMENTS

| | | |
|---|---|---|
| WO | WO 02/28485 | 4/2002 |

OTHER PUBLICATIONS

Surlyn Material Data sheet 8150 and 9150.*

* cited by examiner

*Primary Examiner*—Raeann Gorden
(74) *Attorney, Agent, or Firm*—William B. Lacy

(57) ABSTRACT

A golf ball with reduced driver spin rate is provided. The golf ball comprises a core, an intermediate layer, and a cover. The intermediate layer is formed from a composition having a flexural modulus of at least about 70,000 psi and a melt flow rate of at least about 4 g/10-min. The composition comprises at least one high-acid ionomer. The intermediate layer further has a thickness of less than about 0.025 inches.

20 Claims, No Drawings

GOLF BALL

FIELD OF THE INVENTION

The present invention relates to golf balls, and more particularly to compositions of golf ball layers having desirable mechanical properties.

BACKGROUND OF THE INVENTION

Spin rate is an important characteristic of golf balls for both skilled and recreational golfers. High spin rate allows the more skilled players, such as PGA professionals and low handicapped players, to maximize their control of the golf ball. A high spin rate golf ball is advantageous for an approach shot to the green. The ability to produce and control back spin to stop the ball on the green and side spin to draw or fade the ball substantially improves a player's control over the ball. Hence, the more skilled players generally prefer a golf ball that exhibits high spin rate, in part, off scoring irons, such as the 7-iron club through the sand wedge.

On the other hand, the recreational players who are less adept in intentionally controlling the spin of the ball generally do not prefer a high spin rate golf ball. For these players, slicing and hooking the ball are the more common errors. When a club head strikes a ball improperly, an unintentional side spin is often imparted to the ball, which sends the ball off its intended course. The side spin reduces a player's control over the ball as well as the direct-line distance the ball will travel. A golf ball that spins less tends not to drift off-line erratically if the ball is not hit squarely with the club face. A low spin ball will not cure the hook or slice, but will reduce the adverse effects of the side spin. Hence, recreational players typically prefer a golf ball that exhibits low spin rate.

SUMMARY OF THE INVENTION

The present invention is directed to a golf ball having a core, a cover, and an intermediate layer disposed between the core and the cover. The composition of the intermediate layer comprises a high-acid ionomer having at least about 16% by weight of a carboxylic acid. The high-acid ionomer preferably has melt flow rate of at least about 4 g/10-min, and the carboxylic acid is neutralized by at least about 10% with a metal cation. The composition preferably has a flexural modulus of at least about 70,000 psi and a melt flow rate of at least about 4 g/10-min, more preferably from about 10 g/10-min to about 100 g/10-min.

The core may have a diameter of at least about 1.55 inches, while the intermediate layer may have a thickness of less than about 0.025 inches, preferably from about 0.005 inches to about 0.02 inches. The intermediate layer has an on-ball hardness of preferably less than about 70 Shore D, more preferably less than about 65 Shore D. On the other hand, the composition that forms the intermediate layer has a material hardness of preferably at least about 65 Shore D, more preferably at least about 70 Shore D. The composition may further blend in a modulus-enhancing filler such that the flexural modulus of the composition with the filler is substantially greater than without the filler. Suitable modulus-enhancing fillers include fibers, filaments, flakes, whiskers, wires, tubes, or particulates of nano-scale or micro-scale, formed from a material such as tungsten, tungsten oxide, barium sulfate, carbon black, silica, or titanium oxide.

The invention is also directed to a core/intermediate layer/cover ball construction in which the intermediate layer is formed from a composition that includes a blend of a first and a second high-acid ionomers. Each high-acid ionomer has a carboxylic acid content of at least about 16% by weight and a melt flow rate of at least about 4 g/10-min. The resulting composition has a flexural modulus of at least about 70,000 psi and a melt flow rate of at least about 4 g/10-min. The first and second high-acid ionomers can be neutralized by about 30% to about 100%, and have a weight ratio therebetween from about 5:95 to about 95:5. The composition may have a material hardness of at least about 65 Shore D, and the intermediate layer may have a on-ball hardness of no greater than about 70 Shore D. Preferably, the material hardness of the composition is at least about 70 Shore D, while the on-ball hardness of the intermediate layer is no greater than about 65 Shore D. The composition may further incorporate a modulus-enhancing filler such that the flexural modulus of the composition with the filler is substantially greater than without the filler. The intermediate layer may have a thickness of from about 0.005 inches to about 0.02 inches.

The invention is further directed to a multi-layer golf ball having an intermediate layer formed from a composition that has a blend of a high-acid ionomer and a high-flow material. Preferably, the high-acid ionomer has a carboxylic acid content of at least about 16% by weight, the high-flow material has a melt flow rate of at least about 4 g/10-min, and the composition has a flexural modulus of at least about 70,000 psi and a melt flow rate of at least about 4 g/10-min. The intermediate layer preferably has a thickness of from about 0.005 inches to about 0.02 inches. The high-acid ionomer may have a melt flow rate of less than about 4 g/10-min. The composition may further include a modulus-enhancing filler such that the flexural modulus of the composition with the filler is substantially greater than without the filler.

The high-flow material includes thermoplastic elastomers, high-flow ionomers, non-ionomeric olefin/acid copolymers or terpolymers, partially or fully neutralized polymers, polyamides, polyolefins, polyurethanes, polyurea, epoxies, polyesters, polyetheresters, polyetheramides, polyamides, metallocene-catalyzed polymers, functionalized styrene-butadiene elastomers, styrenic block copolymers, acrylonitrile-butadiene-styrene copolymers, silicone, or metal salts of fatty acids. Preferably, the high-flow ionomers have a carboxylic acid content of at least about 16% by weight, and the non-ionomeric olefin/acid copolymers or terpolymers have a carboxylic acid content of about 5% to about 30% by weight.

Alternatively, the invention disclosed herein directs to a golf ball intermediate layer formed from a composition that comprises at least one high-acid ionomer, and the on-ball hardness of the intermediate layer is substantially less than the material hardness of the composition, preferably by at least about 5 Shore D, more preferably by at least about 10 Shore D. The high-acid ionomer preferably has a melt flow rate of at least about 4 g/10-min, has at least about 16% by weight of a carboxylic acid, and is present in an amount greater than about 30% by weight of the composition. The material hardness of the composition is preferably at least about 65 Shore D, more preferably at least about 70 Shore D. The on-ball hardness of the intermediate layer is preferably less than about 70 Shore D, more preferably less than about 65 Shore D, and most preferably from about 45 Shore D to about 60 Shore D. Preferably, the composition has a melt flow rate of at least about 4 g/10-min, and a flexural modulus of at least about 70,000 psi. The composition may also add a modulus-enhancing filler such that the composition with the filler has a flexural modulus substantially greater than without the filler, and/or at least one high-flow material having a melt flow rate of greater than about 4 g/10-min.

The invention is further directed to a golf ball intermediate layer of less than about 0.025 inches thick, formed from a composition comprising at least one high-acid ionomer, and the intermediate layer has an on-ball hardness less than the material hardness of the composition. The thickness of the intermediate layer preferably ranges from about 0.005 inches to about 0.02 inches. The composition preferably has a flexural modulus of at least about 70,000 psi and a melt flow rate of at least about 4 g/10-min.

The invention is directed to yet another golf ball intermediate layer formed from a composition comprising a blend of a high-acid ionomer having a carboxylic acid content of at least about 16% by weight and thermoplastic elastomer, with a material hardness substantially greater than the on-ball hardness of the intermediate layer. The thermoplastic elastomer may be ionomeric or non-ionomeric. The composition may also comprise a modulus-enhancing filler so that the composition with the filler has a greater flexural modulus than without the filler.

DEFINITIONS

As used herein, the term "flexural modulus" or "modulus" refers to the ratio of stress to strain within the elastic limit (when measured in the flexural mode) of a material and is similar to its tensile modulus. This property is used to indicate the bending stiffness of the material. A three-point loading system is applied to a simply supported beam of the material in the form of rectangular bars molded directly or cut from sheets or plates. A load is applied at the center point of the beam, and the loading nose is pushed onto the beam at a constant rate of 2 mm/min. A load deflection curve is plotted using the recorded data. Flexural modulus is equivalent to the slope of the line tangential to the stress/strain curve, for the portion of the curve where the beam has not yet deformed. Values for flexural modulus are typically reported in Pascal ("Pa") or pounds per square inches ("psi"), among other units. Standard test for flexural modulus is Procedure B of ASTM D6272-98 titled "Standard Test Method for Flexural Properties of Unreinforced and Reinforced Plastics and Electrical Insulating Materials by Four-Point Bending."

As used herein, the term "melt flow rate" ("MFR"), also known as "melt flow index," "melt flow," "melt mass-flow rate," or simply as "flow rate," refers to the rate of extrusion of thermoplastics through an orifice at a prescribed temperature and load. Typically, an extrusion plastometer or rheometer is used, wherein a certain amount of the material is loaded into a barrel of the melt flow apparatus, heated to a temperature specified for the material, and forced through a standardized die of a specified length and diameter by a piston under a specified weight load for the material. A timed extrudate is collected and weighed, and the MFR of the material is calculated in g/10-min. Standard tests for MFR include ASTM D1238-01e1 titled "Standard Test Method for Melt Flow Rates of Thermoplastics by Extrusion Plastometer." The benefits of high MFR include easy extrusion, high extrusion rate, high-flow during heat sealing, and the ability to make thin films of moisture vapor barrier layer. Without limiting the present invention to any particular theory, materials with relatively high MFR have relatively low viscosity. Low viscosity helps the materials spread evenly and thinly to produce a thin film.

As used herein, the term "material hardness" refers to indentation hardness of non-metallic materials in the form of a flat slab or button as measured with a durometer. The non-metallic materials include thermoplastic elastomers, vulcanized (thermoset) rubber, elastomeric materials, cellular materials, gel-like materials, and other rubbers or plastics. The durometer has a spring-loaded indentor that applies an indentation load to the slab, thus sensing its hardness. The material hardness can indirectly reflect upon other material properties, such as tensile modulus, resilience, plasticity, compression resistance, and elasticity. Standard tests for the material hardness include ASTM D2240-02a titled "Standard Test Method for Rubber Property—Durometer Hardness." Material hardness reported herein is in Shore D units.

As used herein, the term "on-ball hardness" refers to the hardness of a portion of a golf ball measured directly on the golf ball (or other spherical surface), and is completely different from the material hardness in nature and in value. The difference in value stems primarily from the components of the golf ball that underlie the portion being measured (i.e., center, core and/or layers), including their construction, size, thickness, and material composition. Therefore, it is understood to one of ordinary skill in the art that the on-ball hardness and the material hardness are not correlated or convertible.

As used therein, the term "compression," also known as "ATTI compression" or "PGA compression," refers to points derived from a Compression Tester (ATTI Engineering Company, Union City, N.J.), a scale well known in the art for determining relative compression of a subject. The Compression Tester is equipped with a Federal Dial Gauge (Model D81-C), and applies a spring-loaded force against the subject, such as a golf ball center, a golf ball core, a core with additional layers, or a whole golf ball. A spring compress of 0.2 inches indicates a compression of 100 for the subject, while a spring compress of 0.1 inches indicates a compression of 0 for the subject. Compression is a property of a material as measured on a golf ball construction (i.e., on-ball property), not a property of the material per se.

As used herein, the term "coefficient of restitution" or "COR" for golf balls is defined as the ratio of a ball's rebound velocity to its initial incoming velocity when the ball is fired out of an air cannon into a rigid vertical plate. The faster a golf ball rebounds, the higher the COR it has, and usually the longer the distance it yields in play. The range of the initial velocity is from about 50 ft/s to about 200 ft/s, and is usually understood to be 125 ft/s, unless otherwise specified. A golf ball may have different COR values at different initial velocities.

As used herein, the term "nano-scale" is defined as having at least one dimension (length, width, height, diameter, etc.) less than about 1 micron, and the term "micro-scale" is defined as having at least one dimension less than about 1 mm.

As used herein, the term "filler" refers to any compound or composition that can be used to vary certain properties of selected portions of the golf ball, including density or specific gravity, flexural modulus, tensile modulus, moment of inertia, hardness, abrasion resistance, weatherability, etc.

The term "about," as used herein in connection with one or more numbers or numerical ranges, should be understood to refer to all such numbers, including all numbers in a range.

DETAILED DESCRIPTION OF THE INVENTION

Golf balls of the present invention may have a variety of multi-layer constructions, comprising at least a core, a cover, and an intermediate layer disposed between the core and the cover. The core may be a single solid mass, or include a center and one or more outer core layers. The center may further be solid, liquid-filled, gel-filled, or gas-filled. The cover may include one or more inner cover layers and an outer cover layer. Any of the outer core layers, the intermediate layers or the inner cover layers may be a wound layer, a molded layer, an adhesive or coupling layer, a continuous or discontinuous layer, a lattice network, a web or net, a layer with uniformed or non-uniformed thickness, a layer having a plurality of discrete elements such as islands and protrusions, a metallic layer, or a foamed layer.

The solid core can be made from any suitable core materials including thermoset plastics; thermoset rubbers such as natural rubber, polybutadiene, polyisoprene, styrene-butadiene and styrene-propylene-diene rubber; thermoplastics such as ionomer resins, polyamides, and polyesters; and thermoplastic elastomers. Suitable thermoplastic elastomers include Pebax® from AtoFina Chemicals Inc., Hytrel® from E.I. Du Pont de Nemours and Company, thermoplastic urethane from various manufacturers, and Kraton® from Shell Chemical Company. The core materials can also be formed from a castable material. Suitable castable materials include those comprising a urethane, polyurea, epoxy, silicone, etc. Additionally, suitable core materials may also include a reaction injection molded ("RIM") polyurethanes or polyurea. Preferred RIM polyurethanes are nucleated versions, where a gas like nitrogen is whipped into the prepolymer prior to injection into a closed mold to form the polyurethane layer.

Preferred compositions for solid cores include a base rubber, a crosslinking agent, and an initiator. The base rubber typically includes natural or synthetic rubbers. A preferred base rubber is 1,4-polybutadiene having a cis-bond of at least about 90%, a Mooney viscosity of at least about 30, a molecular weight of at least about 100,000, and a polydispersity of less than about 4. The measurement of Mooney viscosity is defined according to ASTM D1646-00 titled "Standard Test Methods for Rubber-Viscosity, Stress Relaxation, and Pre-Vulcanization Characteristics (Mooney Viscometer)." Examples of desirable polybutadiene rubbers include Buna® CB22 and CB23 from Bayer, Ubepol® 360L and 150L from Ube Industries, and Cariflex® BCP820 and BCP824 from Shell Chemical. Blends of two or more such polybutadienes having a Mooney viscosity of from about 20 to about 150 are desirable for the solid cores. The polybutadiene can also be mixed with other elastomers known in the art such as natural rubber, polyisoprene rubber and/or styrene-butadiene rubber in order to modify the properties of the core.

Suitable cross-linking agents for the polybutadiene-based solid cores include metal salts of unsaturated fatty acid having 3 to 8 carbon atoms, such as diacrylate, dimethacrylate, and monomethacrylate, wherein the metal can be magnesium, calcium, zinc, aluminum, sodium, lithium or nickel. Preferred acrylates include zinc acrylate, zinc diacrylate ("ZDA"), zinc methacrylate, zinc dimethacrylate, and blends thereof. Zinc diacrylate is preferred because it provides golf balls with a high initial velocity, but the present invention is not limited thereto. The crosslinking agent is typically present in an amount of at least about 10 parts per hundred ("pph") parts of the base polymer, preferably from about 20 to 40 pph of the base polymer.

The polymerization initiators to promote the cross-linking reaction in the core are well known in the art, and can be any known free radical initiators or blends thereof that decompose during the cure cycle. Suitable free radical initiators include organic peroxide compounds, such as dicumyl peroxide; 1,1-di(t-butylperoxy)-3,3,5-trimethylcyclohexane; α,α-bis(t-butylperoxy)diisopropylbenzene; 2,5-dimethyl-2,5-di(t-butylperoxy)-hexane; di-t-butyl peroxide; and blends thereof. Other examples include, but are not limited to, Varox® 231XL and DCP-R from AtoFina, Perkadox® BC and 14 from Akzo Nobel, and Elastochem® DCP-70 from Rhein Chemie. In their pure forms, the initiators are present in an amount of at least about 0.25 pph of the base polymer, preferably between about 0.5 pph and about 2.5 pph. It is understood to one skilled in the art to adjust the amount of the initiators according to their activity and concentration.

In polybutadiene-based solid cores of the present invention, it is preferred to blend in a halogenated organosulfur compound such as a halogenated thiophenol or a metal salt thereof to further enhance the softness and resiliency of the core. The halogenated thiophenol, preferably pentachlorothiophenol ("PCTP") or ZnPCTP, function in part as a cis-to-trans catalyst that convert cis-1,4 bonds in the polybutadiene to trans-1,4 bonds. The utilization of halogenated organosulfur compounds like PCTP and ZnPCTP in golf balls to produce soft and fast cores is disclosed in co-pending U.S. patent application Ser. No. 09/951,963, which is incorporated by reference herein in its entirety. PCTP is available under the tradename Struktol® from Struktol Company of America, and ZnPCTP is available from eChinaChem. The halogenated organosulfur compounds are present in an amount of at least about 2 pph, more preferably between about 2.3 pph and about 5 pph.

The solid core may also include fillers to adjust hardness, strength, modulus, weight, density and/or specific gravity of the core. Suitable fillers include metal or alloy powders, metal oxides and salts, ceramics, particulate, carbonaceous materials, polymeric materials, glass microspheres, organic and/or inorganic fibers, and the like or blends thereof. These fillers may be solid or hollow. Specific fillers for the core include tungsten powder, tungsten carbide, zinc oxide, tin oxide, tungsten oxide, barium sulfate, zinc sulfate, barium carbonate, calcium carbonate, zinc carbonate, an array of silica and clay, and regrind (recycled core material typically ground to about 30 mesh particle).

Other optional additive for the golf ball core are well known in the art, and may be blended into the core in amounts sufficient to achieve their specific purposes and desired effects. Such additives include antioxidants to prevent premature crosslinking or any molecular breakdown of the rubber compound, accelerators to speed up the polymerization reaction, processing aids oils to affect rheological and mixing properties, foaming agents, cis-to-trans catalysts, adhesives, coupling agents, stable free radicals, radical scavangers, scorch retarders, and blends thereof.

The sold core of the golf ball of the present invention preferably has a diameter of at least about 1.3 inches, more preferably at least about 1.5 inches, and most preferably at least about 1.55 inches. In one embodiment, the solid core has a diameter of from about 1.58 inches to about 1.62 inches. The core may have a compression of from about 20 to about 120, more preferably from about 30 to about 110, and most preferably from about 40 to about 100. In one embodiment, the core may be very soft, with a compression of less than about 20. The core should also be highly resilient, having a COR of greater than about 0.8 at 125 ft/sec, more preferably greater than about 0.81, and most preferably greater than about 0.815. Conventional methods and techniques may be used to form the solid cores from the base compositions disclosed herein.

In the preferred embodiment of the present invention, the intermediate layer may be part of the core as an outer core layer, or part of the cover as an inner cover layer. The intermediate layer may be a continuous layer formed from a composition that includes at least one high-acid ionomer. Preferably, the composition of the intermediate layer has a flexural modulus of at least about 70,000 psi and a MFR of at least about 4 g/10-min. The intermediate layer has a thickness of preferably less than about 0.025 inches, more preferably between about 0.005 inches and about 0.02 inches, and most preferably between about 0.01 inches and about 0.015 inches. The intermediate layer is located preferably proximate to the cover, and more preferably adjacent to the cover. Most preferably, the intermediate layer is an inner cover layer that is adjacent to the outer cover layer. The flexural modulus of the composition for the intermediate layer is preferably from about 70,000 psi to about 150,000 psi, more preferably from about 80,000 psi to about 130,000 psi, and most preferably from about 85,000 psi to about 110,000 psi. The MFR of the composition is preferably from about 4 g/10-min to about 500 g/10-min, more preferably from about 10 g/10-min to about 100 g/10-min, and most preferably from about 10 g/10-min to about 75 g/10-min. The composition further has a material hardness of preferably at least about 65 Shore D, more preferably greater than about 70 Shore D, and most preferably greater than about 75. At the same time, the intermediate layer has an on-ball hardness of preferably no greater than about 70 Shore D, more preferably no greater than about 65 Shore D, and most preferably from about 45 Shore D to about 60 Shore D. In another preferred embodiment, the material hardness of composition for the intermediate layer is substantially greater than the on-ball hardness of the intermediate layer, preferably by at least about 5 Shore D, more preferably by at least about 10 Shore D.

Suitable materials for the intermediate layer of the present invention include high-acid ionomers, high-flow ionomers, and blends thereof. High-acid ionomers are ionic copolymers or terpolymers of an olefin having from about 2 to 8 carbon atoms and a carboxylic acid having from about 3 to 8 carbon atoms, with an acid content of at least about 16% by weight. Preferably, the carboxylic acid content in the ionomer is from about 17% to about 25%, and more preferably from about 18% to about 22%. The carboxylic acid may be an unsaturated monocarboxylic acid such as acrylic, methacrylic, crotonic, maleic, fumaric, or itaconic acid. At least about 10% by weight of the carboxylic acid groups are neutralized with a metal cation such as sodium, lithium, zinc, magnesium, etc. Preferably, between about 30% and about 100% of the carboxylic acid groups are neutralized. Examples of high-acid ionomers include copolymers of ethylene and acrylic acid or methacrylic acid. Optionally, a softening comonomer may be incorporated to produce an ionomeric terpolymer. The comonomer includes vinyl esters of aliphatic carboxylic acids wherein the acid has 2 to 10 carbon atoms, alkyl ethers wherein the alkyl group has 1 to 10 carbon atoms, alkyl acrylates wherein the alkyl group has 1 to 10 carbon atoms, or alkyl alkylacrylates such as alkyl methacrylates wherein the alkyl group has 1 to 10 carbon atoms. Examples of the comonomer include vinyl acetate, methyl acrylate, methyl methacrylate, ethyl acrylate, ethyl methacrylate, iso-butyl acrylate, n-butyl acrylate, butyl methacrylate, or the like.

High-acid ionomers are commercially available from several different manufacturers. For example, ionic copolymers of ethylene and methacrylic acid are produced by E. I. DuPont de Nemours & Company under the trademark of Surlyn®, ionic copolymers and terpolymers of ethylene and acrylic acid are produced by ExxonMobil Chemical under the trademarks of Escor® and Iotek®, filler-modified poly (ethylene-methacrylic acid) ionomers are produced by DuPont under the trademark of Bexloy®, ionomeric polyethylene copolymers are produced by A. Schulman Inc. under the trademark of Formion®, and polyolefin ionomers are produced by Diamond & Network Polymers, Inc. Exemplary high-acid ionomers include Surlyn® 6120, 8140, 8150, 9120, 9150, and certain high-flow ionomers that are under development. Preferably, the high-acid ionomers have a mole percent acid content of at least about 5.5%, a flexural modulus of at least about 50,000 psi, a Shore D hardness of at least about 60, a Vicat softening point of at least about 50° F., a melting point of at least about 80° F., and a freezing point of less than about 55° F.

The thinness of the intermediate layer requires its composition to have substantially high MFR to ease the processing. Certain high-acid ionomers such as Surlyn® 8150 and 9150 are also high-flow ionomers that have MFR's greater than about 4 g/10-min. The high-acid and high-flow ionomers may be used solely or in blends thereof to form the intermediate layers of the present invention. The total amount of the ionomers in the composition is preferably greater than about 30% by weight. In one embodiment, the composition of the intermediate layer comprises at least one high-acid and high-flow ionomer such as Surlyn® 8150 or 9150. In another embodiment, the composition comprises a blend of at least two high-acid and high-flow ionomers such as Surlyn® 8150 and 9150. The weight ratio between the two ionomers ranges preferably from about 5:95 to about 95:5, more preferably from about 25:75 to about 75:25, and most preferably about 50:50. To incorporate other high-acid ionomers of low flow (MFR less than 4 g/10-min, typically between about 0.5 g/10-min and 4 g/10-min) in the intermediate layer, it is desirable to blend in a certain amount of high-flow materials. Preferred high-flow materials have a MFR of greater than about 4 g/10-min, and more preferred ones have a MFR of greater than about 10 g/10-min. Suitable high-flow materials are thermoplastic elastomers, and include any of the high-flow ionomers described above, as well as olefin/acid copolymers and terpolymers, partially or fully neutralized polymers, polyamides, polyolefins, polyurethanes, polyurea, cast or RIM thermoplastic polyurethanes or polyurea, epoxies, polyesters, polyetheresters such as Hytrel® from DuPont, polyetheramides such as Pebax® from AtoFina, urethanes, nylons, metallocene-catalyzed polymers, functionalized styrene-butadiene elastomers, styrenic block copolymers such as Kraton® from Shell Chemicals, acrylonitrile-butadiene-styrene copolymers ("ABS"), silicone, metal salts of fatty acids, and blends thereof.

In a further embodiment, the blend composition for the intermediate layer comprises a high-acid and low-flow ionomer and a high-flow material. Preferred high-flow materials include non-ionomeric copolymers of an olefin having from about 2 to 8 carbon atoms and a carboxylic acid having from about 3 to 8 carbon atoms, and non-ionomeric terpolymers of an olefin and a softening comonomer and a carboxylic acid, with an acid content ranging from about 5% to about 30% by weight. Examples of such thermoplastic elastomers include copolymers of ethylene and acrylic acid or methacrylic acid and terpolymers of ethylene and methyl acrylate and acrylic acid, such as Nucrel® from DuPont, Escor® from Exxon Mobil and Primacor® from Dow Chemicals. These olefin/acid copolymers and terpolymers not only have MFR as high as about 500 g/10-min, but also are chemically compatible with the high-acid ionomers.

Alternatively, the high-flow material may be any of those described above. Other materials applicable in the blend for the intermediate layer include any center, core, mantle or cover materials disclosed in U.S. Pat. Nos. 6,149,535, 6,152,834, 6,025,442, 5,919,100, 5,885,172, 5,824,740, 5,692,974, and 5,567,772, as well as in U.S. patent application Ser. Nos. 10/160,827, 10/118,719, 09/960,208, and 09/853,252. The entire disclosures of these patents and applications are incorporated herein by reference. Also suitable for the intermediate layer is a loaded thin film or "prepreg" or a "densified loaded film," as described in U.S. Pat. No. 6,010,411 related to golf clubs, and incorporated by reference herein. Such films are available from the Cytec of Anaheim, Calif. or Bryte of San Jose, Calif. These high-flow materials may be chemically modified with functional groups to achieve compatibility and enable blending with the high-acid ionomer. Suitable compatibilizing agents may be used for the same purposes.

The intermediate layer may also be loaded with a modulus-enhancing filler so that the layer attains the preferred physical and mechanical properties described above, particularly the high flexural modulus. Indeed, it has been demonstrated that the addition of certain fillers substantially increases the flexural modulus of the composition. Suitable fillers for the intermediate layer include, for example, metal (or metal alloy) powder, metal oxide and salts, particulate, carbonaceous materials, and the like or blends thereof. Examples of useful metal (or metal alloy) powders include, but are not limited to, bismuth powder, boron powder, brass powder, bronze powder, cobalt powder, copper powder, inconel metal powder, iron metal powder, molybdenum powder, nickel powder, stainless steel powder, titanium metal powder, zirconium oxide powder, aluminum flakes, tungsten metal powder, beryllium metal powder, zinc metal powder, or tin metal powder. Examples of metal oxides include but are not limited to zinc oxide, iron oxide, aluminum oxide, titanium dioxide, magnesium oxide, zirconium oxide, and tungsten trioxide. Examples of particulates carbonaceous materials include but are not limited to graphite and carbon black. Examples of other useful fillers include but are not limited to graphite fibers, precipitated hydrated silica, clay, talc, glass fibers, aramid fibers, mica, calcium metasilicate, barium sulfate, zinc sulfide, silicates, diatomaceous earth, calcium carbonate, magnesium carbonate, regrind (which is recycled cured center material mixed and ground to 30 mesh particle size), manganese powder, and magnesium powder. Preferably, the modulus-enhancing fillers include tungsten, tungsten oxide, barium sulfate, carbon black, silica, titanium oxide, or a blend thereof. The fillers are preferably in the forms of nano-scale or micro-scale fibers, filaments, flakes, whiskers, wires, tubes, or particulate. The fillers may be present in the composition of the intermediate layer in an amount sufficient to substantially increase the flexural modulus of the composition. Preferably, the amount of the fillers in the composition ranges from about 5% to about 70% by weight, more preferably from about 10% to about 50% by weight. Of course, appropriate amounts of the fillers should be used to confine the weight of the golf ball to United States Golf Association ("USGA") upper limit of 1.62 ounces.

The intermediate layer and its compositions of the present invention are useful in any and all golf ball constructions, and can be integrated into any portion of the ball, including the core and the cover. For example, the compositions may form an intermediate layer in a multi-layer golf ball having a cover thicker than 0.05 inches, an inner cover layer for a multi-layer ball having two or more cover layers, or an outer core layer sandwiched between two or more thermoset layers. The compositions may be applied as a liquid, dispersion, lacquer, paste, gel, melt, or solid half shells. The intermediate layer may be formed around the core or onto the inside of the cover by compression molding, injection molding, RIM, lamination, casting, spraying, dipping, powder coating, any other deposition means, or combinations of these methods. Because of the thinness of the intermediate layer, preferred methods of production include RIM, thin-wall injection molding, injection and compression molding, liquid spray coating, powder spray coating, and the like.

When injection molding the layer, it is critical not to have too much of the composition material around the underlying golf ball component such as the core, because the very small space between the mold and the core will not allow the material to flow property. Even worse, the core may "blow out," in which the injected material under very high pressure pushes into the core and cause the core to rupture along its parting line. To prevent "blow-outs," the injection molding process is modified to first mold a pre-form layer about twice as thick as the desired intermediate layer from the composition material. Preferably, the pre-form layer has a thickness between about 0.01 inches and 0.05 inches. Then the pre-form layer is compression molded to reduce its thickness and form the desired intermediate layer. Retractable pin molding may be used in combination with runners and injection gates having large enough diameters to allow the use of more material due to higher melting temperatures of the materials. Alternatively, the pre-form layer formed from the injection molded half shells may be thinned down to the intermediate layer by grinding or multiple steps of progressive compression molding. Equipment for grinding includes a centerless grinder or a tumbling grinder. In golf balls where the outer cover layer is of a non-urethane composition, the intermediate layer and the outer cover layer may be co-injection molded.

The cover of the golf ball provides the interface between the ball and a club and other objects such as trees, cart paths, and grass. Properties that are desirable for the cover include high abrasion resistance, high tear strength, and high resilience. The cover generally provides sufficient strength for good performance characteristics and durability. The cover may comprise one or more layers, including inner cover layers and outer cover layer. The cover can be comprised of the following homopolymeric and copolymeric materials used solely or in conjunction with one another, including:

(1) Non-ionomeric acid polymers such as copolymers of an olefin and a carboxylic acid or terpolymers of an olefin and a softening comonomer and a carboxylic acid, in which the olefin has from 2 to 8 carbon atoms and the carboxylic acid has 3 to 8 carbon atoms. The carboxylic acid groups may include acrylic, methacrylic, crotonic, maleic, fumaric or itaconic acid. The softening comonomer includes vinyl esters of aliphatic carboxylic acids wherein the acid has 2 to 10 carbon atoms, alkyl ethers wherein the alkyl group has 1 to 10 carbon atoms, alkyl acrylates wherein the alkyl group has 1 to 10 carbon atoms, or alkyl alkylacrylates wherein the alkyl group has 1 to 10 carbon atoms. Preferred non-ionomeric acid polymers include Nucrel® from E. I. DuPont de Nemours & Company and Escor® from ExxonMobil. These are copolymers or terpolymers of ethylene and methacrylic acid or acrylic acid partially neutralized. Preferably these ionomers comprises at least about 10% by weight of the carboxylic acid, more preferably at least about 16% by weight.

(2) Ionomers such as ionic versions of the copolymers or terpolymers described in (1) above. Specifically, the carboxylic acid groups are partially or fully neutralized with cations. Preferred ionomers include Surlyn® from E. I. DuPont de Nemours & Company and Iotek® from Exxon-Mobil. These are copolymers or terpolymers of ethylene and methacrylic acid or acrylic acid partially neutralized with zinc, sodium. lithium, magnesium, potassium, calcium, manganese, nickel or the like.

(3) Polyolefins such as polyethylene, polypropylene, polybutylene and copolymers such as ethylene methylacrylate, ethylene ethylacrylate, ethylene vinyl acetate, copolymers and homopolymers produced using single-site catalyst such as metallocene.

(4) Polyurethanes such as those prepared from polyols and diisocyanates or polyisocyanates, including thermoplastic polyurethanes, thermoset polyurethanes, and polyurethane ionomers.

(5) Polyurea such as thermoplastic polyurea, thermoset polyurea, polyurea ionomers, and include those disclosed in U.S. Pat. No. 5,484,870, U.S. patent application Ser. Nos. 10/072,395 and 10/228,311, all of which are incorporated herein by reference in their entirety.

(6) Vinyl resins such as those formed by the polymerization of vinyl chloride, or by the copolymerization of vinyl chloride with vinyl acetate, acrylic esters or vinylidene chloride.

(7) Polyamides such as poly(hexamethylene adipamide) and others prepared from diamines and dibasic acids, as well as those from amino acids such as poly(caprolactam), and blends of polyamides with Surlyn, polyethylene, ethylene copolymers, ethyl-propylene-non-conjugated diene terpolymer, etc.

(8) Acrylic resins and blends of these resins with poly vinyl chloride, elastomers, etc.

(9) Vulcanized synthetic or natural rubbers such as balata.

(10) Thermoplastics such as the urethanes, olefinic thermoplastic rubbers such as blends of polyolefins with ethylene-propylene-non-conjugated diene terpolymer, block copolymers of styrene and butadiene, thermoplastic block copolymers such as Kraton® rubbers from Shell Chemical, isoprene or ethylene-butylene rubber, or co-polyetheramide, such as Pebax® from AtoFina.

(11) Polyphenylene oxide resins, or blends of polyphenylene oxide with high impact polystyrene such as Noryl® from General Electric Company.

(12) Thermoplastic polyesters, such as polyethylene terephthalate, polybutylene terephthalate, polyethylene terephthalate/glycol modified and elastomers, including Hytrel® from E. I. DuPont de Nemours & Company and Lomod® from General Electric Company.

(13) Blends and alloys, including polycarbonate with acrylonitrile-butadiene-styrene, polybutylene terephthalate, polyethylene terephthalate, styrene maleic anhydride, polyethylene, elastomers, polyvinyl chloride with acrylonitrile butadiene styrene or ethylene vinyl acetate or other elastomers, blends of thermoplastic rubbers with polyethylene, propylene, polyacetal, nylon, polyesters, cellulose esters, etc.

Any of the cover layers may be formed from polymers containing $\alpha,\beta$-unsaturated carboxylic acid groups, or the salts thereof, that have been highly neutralized with cations. The acid moieties of the highly neutralized ionomers, typically ethylene-based ionomers, are preferably neutralized by at least about 70%, more preferably by greater than about 90%, and most preferably by about 100%. The highly neutralized ionomers can be also be blended with a second polymer component, which, if containing an acid group, may also be neutralized. The second polymer component, which may be partially or fully neutralized, preferably comprises ionomeric copolymers and terpolymers, ionomer precursors, thermoplastics, polyamides, polycarbonates, polyesters, polyurethanes, polyurea, thermoplastic elastomers, polybutadiene rubber, balata, metallocene-catalyzed polymers (grafted and non-grafted), single-site polymers, high-crystalline acid polymers, cationic ionomers, and the like.

Polyurethane-type materials may form cover layers or any other layers in the golf balls of the present invention, preferably outer cover layers. Suitable polyurethanes include, but are not limited to, thermoset polyurethanes, thermoplastic polyurethanes, polyurethane ionomers, polyurethane-urea, polyurea-urethanes, or polyurethane-epoxies, that comprise the reaction product of at least one polyisocyanate, polyol, and at least one curing agent.

Any polyisocyanate available to one of ordinary skill in the art is suitable for use according to the invention. Exemplary polyisocyanates include, but are not limited to, 4,4'-diphenylmethane diisocyanate ("MDI"); polymeric MDI; carbodiimide-modified liquid MDI; 4,4'-dicyclohexylmethane diisocyanate ("HMDI"); p-phenylene diisocyanate ("PPDI"); m-phenylene diisocyanate ("MPDI"); toluene diisocyanate ("TDI"); 3,3'-dimethyl-4,4'-biphenylene diisocyanate ("TODI"); isophorone diisocyanate ("IPDI"); hexamethylene diisocyanate ("HDI"); naphthalene diisocyanate ("NDI"); xylene diisocyanate ("XDI"); p-tetramethylxylene diisocyanate ("p-TMXDI"); m-tetramethylxylene diisocyanate ("m-TMXDI"); ethylene diisocyanate; propylene-1,2-diisocyanate; tetramethylene-1,4-diisocyanate; cyclohexyl diisocyanate; 1,6-hexamethylene-diisocyanate ("HDI"); dodecane-1,12-diisocyanate; cyclobutane-1,3-diisocyanate; cyclohexane-1,3-diisocyanate; cyclohexane-1,4-diisocyanate; 1-isocyanato-3,3,5-trimethyl-5-isocyanatomethylcyclohexane; methyl cyclohexylene diisocyanate; triisocyanate of HDI; triisocyanate of 2,4,4-trimethyl-1,6-hexane diisocyanate ("TMDI"); tetracene diisocyanate; naphthalene diisocyanate; anthracene diisocyanate; isocyanurate of toluene diisocyanate; uretdione of hexamethylene diisocyanate; and mixtures thereof. Preferably, the polyisocyanate includes MDI, PPDI, TDI, or a mixture thereof. It should be understood that, as used herein, the term "MDI" includes 4,4'-diphenylmethane diisocyanate, polymeric MDI, carbodiimide-modified liquid MDI, and mixtures thereof and, additionally, that the diisocyanate employed may be "low free monomer," understood by one of ordinary skill in the art to have lower levels of "free" monomer isocyanate groups, typically less than about 0.1% free monomer groups. Examples of "low free monomer" diisocyanates include, but are not limited to Low Free Monomer MDI, Low Free Monomer TDI, and Low Free Monomer PPDI. The polyisocyanate should have less than about 14% unreacted NCO groups. Preferably, the at least one polyisocyanate has no greater than about 7.5% NCO, and more preferably, less than about 7.0%. It is well understood in the art that the hardness of polyurethane can be correlated to the percent of unreacted NCO groups.

Any polyol available to one of ordinary skill in the art is suitable for use according to the invention. Exemplary polyols include, but are not limited to, polyether polyols, hydroxy-terminated polybutadiene (including partially or fully hydrogenated derivatives), polyester polyols, polycaprolactone polyols, and polycarbonate polyols. In one preferred embodiment, the polyol includes a polyether polyol, such as polytetramethylene ether glycol ("PTMEG"), polyethylene propylene glycol, polyoxypropylene glycol, and mixtures thereof. The hydrocarbon chain can have saturated or unsaturated bonds and substituted or unsubstituted aromatic and cyclic groups. Preferably, the polyol of the present invention includes PTMEG. Suitable polyester polyols include, but are not limited to, polyethylene adipate glycol; polybutylene adipate glycol; polyethylene propylene adipate glycol; o-phthalate-1,6-hexanediol; poly(hexamethylene adipate)glycol; and mixtures thereof. The hydrocarbon chain can have saturated or unsaturated bonds, or substituted or unsubstituted aromatic and cyclic groups. Suitable polycaprolactone polyols include, but are not limited to, 1,6-hexanediol-initiated polycaprolactone, diethylene glycol initiated polycaprolactone, trimethylol propane initiated polycaprolactone, neopentyl glycol initiated polycaprolactone, 1,4-butanediol-initiated polycaprolactone, PTMEG-initiated polycaprolactone, and mixtures thereof. The hydrocarbon chain can have saturated or unsaturated bonds, or substituted or unsubstituted aromatic and cyclic groups. Suitable polycarbonates include, but are not limited to, polyphthalate carbonate and poly (hexamethylene carbonate)glycol. The hydrocarbon chain can have saturated or unsaturated bonds, or substituted or unsubstituted aromatic and cyclic groups.

Curing agents for polyurethanes of the present invention include hydroxyl-terminated curatives and amine curatives. Suitable hydroxyl-terminated curatives may be diols, triols or tetraols, and include ethylene glycol; diethylene glycol; polyethylene glycol; propylene glycol; polypropylene glycol; lower molecular weight polytetramethylene ether glycol; 1,3-bis(2-hydroxyethoxy)benzene; 1,3-bis-[2-(2-hydroxyethoxy)ethoxy]benzene; 1,3-bis-{2-[2-(2-hydroxyethoxy)ethoxy]ethoxy}benzene; 1,4-butanediol; 1,5-pentanediol; 1,6-hexanediol; resorcinol-di-(β-hydroxyethyl)ether; hydroquinone-di-(β-hydroxyethyl) ether; and mixtures thereof. Preferred hydroxyl-terminated curatives include 1,3-bis(2-hydroxyethoxy) benzene; 1,3-bis-[2-(2-hydroxyethoxy)ethoxy]benzene; 1,3-bis-{2-[2-(2-hydroxyethoxy) ethoxy]ethoxy}benzene; 1,4-butanediol, and mixtures thereof.

Amine curatives, including both primary and secondary amines, are also suitable for use in polyurethane covers or layers. Particular amine curatives include, but are not limited to, 3,5-dimethylthio-2,4-toluenediamine and isomers thereof; 3,5-diethyltoluene-2,4-diamine and isomers thereof, such as 3,5-diethyltoluene-2,6-diamine; 4,4'-bis-(sec-butylamino)-diphenylmethane; 1,4-bis-(sec-butylamino)-benzene, 4,4'-methylene-bis-(2-chloroaniline); 4,4'-methylene-bis-(3-chloro-2,6-diethylaniline) ("MCDEA"); polytetramethyleneoxide-di-p-aminobenzoate; N,N'-dialkyldiamino diphenyl methane; p,p'-methylene dianiline ("MDA"); m-phenylenediamine ("MPDA"); 4,4'-methylene-bis-(2-chloroaniline) ("MOCA"); 4,4'-methylene-bis-(2,6-diethylaniline) ("MDEA"); 4,4'-methylene-bis-(2,3-dichloroaniline) ("MDCA"); 4,4'-diamino-3,3'-diethyl-5,5'-dimethyl diphenylmethane; 2,2',3,3'-tetrachloro-diamino-diphenylmethane; trimethylene glycol di-p-aminobenzoate; and mixtures thereof. Preferred polyamine curatives include 3,5-dimethylthio-2,4-toluenediamine and isomers thereof, such as Ethacure® 300 from Albermarle Corporation.

Both the hydroxyl-terminated and amine-terminated curatives can include one or more saturated, unsaturated, aromatic, and cyclic groups. Additionally, the hydroxyl-terminated and amine curatives can include one or more halogen groups. The polyurethane composition can be formed with a blend or mixture of curing agents. If desired, however, the polyurethane composition may be formed with a single curing agent.

One method well known to the skilled artisan for making polyurethanes is the prepolymer method, wherein a polyurethane prepolymer is produced by reacting at least one polyol with at least one isocyanate. The prepolymer can then be cured with a diol curative or a secondary amine curative to form a thermoplastic polyurethane, or cured with a triol or tetraol curative to form a thermoset polyurethane. The choice of the curatives is critical because some prepolymers cured with diols do not produce urethane elastomers with the impact resistance suitable for a golf ball cover. Blending amine curatives in diol-cured polyurethane compositions may result in thermoset polyurethanes with improved impact and cut resistance. Other suitable thermoplastic polyurethane resins include those disclosed in U.S. Pat. No. 6,235,830, which is incorporated herein by reference in its entirety.

In a preferred embodiment of the present invention, saturated (aliphatic and alicyclic) polyurethanes formed from saturated polyisocyanates, saturated polyols and saturated curatives are used to form cover layers, preferably the outer cover layer. As used herein, the term "saturated" refers to a compound or material that is substantially free of aromatic groups or moieties. Saturated polyisocyanates include, but are not limited to, ethylene diisocyanate; propylene-1,2-diisocyanate; tetramethylene-1,4-diisocyanate; 1,6-hexamethylene-diisocyanate; 2,2,4-trimethylhexamethylene diisocyanate; 2,4,4-trimethylhexamethylene diisocyanate; dodecane-1,12-diisocyanate; dicyclohexylmethane diisocyanate; cyclobutane-1,3-diisocyanate; cyclohexane-1,3-diisocyanate; cyclohexane-1,4-diisocyanate; 1-isocyanato-3,3,5-trimethyl-5-isocyanatomethylcyclohexane; IPDI; methyl cyclohexylene diisocyanate; triisocyanate of HDI; TMDI. The most preferred saturated diisocyanates are 4,4'-dicyclohexylmethane diisocyanate and IPDI.

Saturated polyols include, but are not limited to, polyether polyols such as polytetramethylene ether glycol and poly (oxypropylene)glycol. Suitable saturated polyester polyols include polyethylene adipate glycol, polyethylene propylene adipate glycol, polybutylene adipate glycol, polycarbonate polyol and ethylene oxide-capped polyoxypropylene diols. Saturated polycaprolactone polyols which are useful in the invention include diethylene glycol initiated polycaprolactone, 1,4-butanediol initiated polycaprolactone, 1,6-hexanediol initiated polycaprolactone; trimethylol propane initiated polycaprolactone, neopentyl glycol initiated polycaprolactone, PTMEG-initiated polycaprolactone. The most preferred saturated polyols are PTMEG and PTMEG-initiated polycaprolactone.

Suitable saturated curatives include 1,4-butanediol, ethylene glycol, diethylene glycol, polytetramethylene ether glycol, propylene glycol; trimethanolpropane; tetra-(2-hydroxypropyl)-ethylenediamine; isomers and mixtures of isomers of cyclohexyldimethylol, isomers and mixtures of isomers of cyclohexane bis(methylamine); triisopropanolamine, ethylene diamine, diethylene triamine, triethylene tetramine, tetraethylene pentamine, 4,4'-dicyclohexylmethane diamine, 2,2,4-trimethyl-1,6-hexanediamine; 2,4,4-trimethyl-1,6-hexanediamine; diethyleneglycol di-(aminopropyl)ether; 4,4'-bis-(sec-butylamino)-dicyclohexylmethane; 1,2-bis-(sec-butylamino)cyclohexane; 1,4-bis-(sec-butylamino) cyclohexane; isophorone diamine, hexamethylene diamine, propylene diamine, 1-methyl-2,4-cyclohexyl diamine, 1-methyl-2,6-cyclohexyl diamine, 1,3-diaminopropane, dimethylamino propylamine, diethylamino propylamine, imido-bis-propylamine, isomers and mixtures of isomers of diaminocyclohexane, monoethanolamine, diethanolamine, triethanolamine, monoisopropanolamine, and diisopropanolamine. The most preferred saturated curatives are 1,4-butanediol, 1,4-cyclohexyldimethylol and 4,4'-bis-(sec-butylamino)-dicyclohexylmethane.

Preferably, the saturated polyurethane comprises by weight from about 1 to about 100%, more preferably from about 10 to about 75% of the cover or layer composition. The thermoset polyurethanes may be castable, reaction injection moldable, sprayable, or applied in a laminate form or by any technical known in the art. The thermoplastic polyurethanes may be processed using any number of compression or injection techniques.

Conventional additives for golf ball cores, covers, and layers may be blended with any compositions disclosed herein for any portion of the golf ball. Such additives include catalysts; surfactants; blowing agents for foams; stabilizers; metals; antioxidants; colorants including pigments and dyes; optical brighteners; density- or modulus-adjusting fillers; viscosity modifiers; release agents; plasticizers; processing aids and oils; compatibility agents; dispersing agents; UV absorbers, hindered amine light stabilizers, etc. Pigments may be fluorescent, autofluorescent, luminescent, or chemoluminescent, and include white pigments such as titanium oxide and zinc oxide. Suitable catalysts for polyurethane-based covers or layers include, but are not limited to bismuth catalyst, oleic acid, triethylenediamine (Dabco®-33LV), di-butyltin dilaurate (Dabco®-T12) and acetic acid. The most preferred catalyst is di-butyltin dilaurate (Dabco®-T12). Dabco® materials are manufactured by Air Products and Chemicals, Inc. Suitable UV absorbers and light stabilizers include Tinuvin® 213, 328, 622, 765 and 770. Tinuvin® products are available from Ciba-Geigy. These additives may be present in any amounts that will achieve their desired purposes.

Any method known to one of ordinary skill in the art may be used to produce the polyurethane-based covers of the present invention. One-shot method involving concurrent mixing of the polyisocyanate, polyol, and curing agent is feasible, but the resulting mixture is non-homogenous and difficult to control. A preferred method of mixing is known as a prepolymer method. In this method, the polyisocyanate and the polyol are mixed separately prior to addition of the curing agent. This method affords a more homogeneous mixture resulting in a more consistent polymer composition. Other methods suitable for forming the layers of the present invention include reaction injection molding ("RIM"), liquid injection molding ("LIM"), injection and compression molding, pre-reacting the components to form an injection moldable thermoplastic polyurethane and then injection molding, and combinations thereof. Castable and reactive materials such as urethane elastomers, when applied in a fluid form, can provide very thin layers such as outer cover layers that are desirable on golf balls. Specific application techniques include spraying, dipping, spin coating, or flow coating methods.

The outer cover layer of the above-disclosed compositions preferably has a flexural modulus, as measured in accordance to ASTM D6272-98, of from about 500 psi to about 15,000 psi. The outer cover layer is preferably thin with a thickness of less than about 0.05 inches, and more preferably less than about 0.03 inches. Alternatively, the cover thickness is between about 0.05 inches and about 0.2 inches, more specifically from about 0.05 to about 0.09 inches. The outer cover layer may have any on-ball hardness, but typically less than about 70 Shore D. The composition of the outer cover layer preferably has a material hardness of less than about 70 Shore D. The resulting golf ball, including the core, the intermediate layer and the cover as described above, preferably has a COR of at least about 0.8, and more preferably at least about 0.81. The golf ball preferably has an Atti compression of at least about 30, more preferably from about 50 to about 120, and most preferably from about 55 to about 85. The golf ball preferably has an overall diameter of at least about 1.68 inches, the minimum size set forth by the United States Golf Association. More preferably the overall diameter of the golf ball is from about 1.68 inches to about 1.76 inches. The golf ball has a dimple coverage on its outermost surface of greater than about 60%, preferably greater than about 80%. Preferred dimple patterns are disclosed in U.S. Pat. Nos. 6,358,161 and 5,957,786. The golf ball further has improved aerodynamic performance such as lift and drag according to the co-pending U.S. application Ser. No. 10/096,852. These patents and applications are incorporated by reference in their entirety.

The compositions for the intermediate layer of golf balls as disclosed herein may be used in sporting equipment in general. Specifically, the compositions may be applied in various game balls, golf club shafts, golf club head inserts, golf shoe components, and the like.

The present invention is further illustrated by the following non-limiting examples.

EXAMPLES

Table 1 shows the physical and performance properties of Sample 1 golf balls having a preferred construction and material composition of the present invention, in comparison to Pro V1 golf balls by Acushnet Company. Subjects for comparison are the cores, the subassemblies (core and intermediate layer), and the finished balls (core plus intermediate layer and cover). The intermediate layer of Sample 1 has a thickness of about 0.015 inches and comprises a blend of Surlyn® 8150 and 9150 at 50:50 by weight. At the levels of the core, the subassembly, and the finished ball, Sample 1 is consistently lower in compression and more resilient than Pro V1. The aging tests at 1-wk and 2-wk show that Sample 1 golf balls are very resistant to weathering.

TABLE 1

| Subject | Diameter (inches) | Weight (g) | Atti Compression | COR at 125 ft/s | Shore D Hardness | Shore C Hardness |
|---|---|---|---|---|---|---|
| Pro V1 Core | 1.550 | 1.291 | 73 | 0.801 | 45 | 77 |
| Sample 1 Core | 1.588 | 1.389 | 54 | 0.814 | 42 | 76 |
| Pro V1 Subassembly | 1.619 | 1.440 | 79 | 0.806 | 57 | 89 |

TABLE 1-continued

| Subject | Diameter (inches) | Weight (g) | Atti Compression | COR at 125 ft/s | Shore D Hardness | Shore C Hardness |
|---|---|---|---|---|---|---|
| Sample 1 Subassembly | 1.619 | 1.458 | 59 | 0.823 | 51 | 80 |
| Pro V1 Finished Ball | 1.683 | 1.604 | 90 | 0.807 | 58 | 76 |
| Sample 1 Finished Ball | 1.685 | 1.620 | 66 | 0.820 | 59 | 77 |
| Sample 1 Subassembly Aging (1-wk) | 1.619 | 1.457 | 61 | 0.824 | 56 | 80 |
| Sample 1 Subassembly Aging (2-wk) | 1.618 | 1.459 | 62 | 0.823 | 53 | 84 |

Comparison in spin rates between Sample 1 golf balls, Pro V1 and Pinnacle® Gold LS (both by Acushnet Company) is depicted in Table 2 below. Sample 1 and conventional balls display comparable initial velocities off various clubs. Advantageously, Sample 1 golf balls produce substantially less spin off drivers than Pro V1, by at least about 12%. At the Pro level (167 ft/s), the reduction in spin is about 13%; at the Standard level (160 ft/s), the spin reduction is about 12.4%; and at the Average level (140 ft/s), the spin reduction is highest, about 14.5%. This spin reduction effect of Sample 1 golf balls diminishes in short iron and wedge shots. For #8 iron, full wedge and half wedge, the spin reductions are 11.7%, 6.2%, and 5.3%, respectively.

TABLE 2

| Club | Ball | Launch Angle (°) | Spin Rate (rpm) | Initial Velocity (ft/s) |
|---|---|---|---|---|
| Pro Driver (167 ft/s) | Pinnacle ® Gold | 9.7 | 2556 | 168.2 |
| | Titleist ® Pro V1 | 9.2 | 2852 | 167.8 |
| | Sample 1 | 9.2 | 2484 | 165.5 |
| Standard Driver (160 ft/s) | Pinnacle ® Gold | 9.4 | 2958 | 161.4 |
| | Titleist ® Pro V1 | 9.0 | 3244 | 160.8 |
| | Sample 1 | 9.3 | 2841 | 160.4 |
| Average Driver (140 ft/s) | Pinnacle ® Gold | 10.9 | 3322 | 140.5 |
| | Titleist ® Pro V1 | 10.6 | 3688 | 139.9 |
| | Sample 1 | 10.8 | 3151 | 141.0 |
| #8 Iron | Pinnacle ® Gold | 20.1 | 7750 | 115.9 |
| | Titleist ® Pro V1 | 19.3 | 8152 | 116.2 |
| | Sample 1 | 20.2 | 7198 | 116.6 |
| Full Wedge | Pinnacle ® Gold | 26.4 | 8012 | 94.5 |
| | Titleist ® Pro V1 | 24.1 | 9443 | 95.6 |
| | Sample 1 | 24.6 | 8860 | 96.7 |
| Half Wedge | Pinnacle ® Gold | 37.5 | 4169 | 52.8 |
| | Titleist ® Pro V1 | 31.0 | 6928 | 54.0 |
| | Sample 1 | 32.1 | 6561 | 54.8 |

Samples A–J are constructed in accordance with the present invention, each having a PBD core (CB-23 from Bayer and ZDA) of 1.59 inch in diameter, a polyurethane cover of 58 Shore D in hardness, and a 0.015-inch thick intermediate layer having a composition as listed in Table 3. The cores having a compression of 75 are higher in ZDA level than the cores having a compression of 50. The intermediate layers comprise Surlyn® of various grades, and incorporate different levels of tungsten oxide as a high-density filler. Table 4 below demonstrates the spin rates of Samples A–J off standard driver ("D"), #8 iron ("I") and half wedge ("W") as compared to Titleist® Pro V1 and Pinnacle® Gold LS by Acushnet Company.

TABLE 3

| Ball | Construction & Composition* | Atti Compression | Weight (g) | COR** |
|---|---|---|---|---|
| Control | Pro V1 | 88 | 1.609 | 0.806 |
| Sample A | 75/8150/0 | 84 | 1.611 | 0.827 |
| Sample B | 75/8150/29 | 82 | 1.618 | 0.824 |
| Sample C | 75/8150/58 | 84 | 1.615 | 0.823 |
| Sample D | 75/9150/29 | 80 | 1.612 | 0.820 |
| Sample E | 75/9150/58 | 83 | 1.613 | 0.823 |
| Sample F | 50/9150/58 | 62 | 1.606 | 0.810 |
| Sample G | 50/9150/29 | 62 | 1.612 | 0.810 |
| Sample H | 50/9150/0 | 61 | 1.604 | 0.810 |
| Sample I | 50/8150/0 | 63 | 1.606 | 0.814 |
| Sample J | 50/8150/29 | 64 | 1.611 | 0.813 |

*(Core Compression)/(Surlyn ® Grade in IL)/(% Tungsten Oxide in IL)
**COR measured at 125 ft/s

TABLE 4

| | Launch Angle (°) | | | Spin Rate (rpm) | | | Initial Velocity (ft/s) | | |
|---|---|---|---|---|---|---|---|---|---|
| Ball | D[1] | I[2] | W[3] | D | I | W | D | I | W |
| Pinnacle ® Gold LS | 9.6 | 19.5 | 35.3 | 2801 | 8297 | 5192 | 161.5 | 114.0 | 52.7 |
| Titleist ® Pro V1 | 9.1 | 19.1 | 31.6 | 3271 | 8418 | 6782 | 161.4 | 114.6 | 53.5 |
| 75/8150/0 | 9.2 | 19.4 | 31.6 | 3124 | 8336 | 6831 | 163.0 | 115.7 | 54.2 |
| 75/8150/29 | 9.1 | 19.0 | 31.3 | 3170 | 8279 | 6849 | 161.3 | 115.8 | 54.2 |
| 75/8150/58 | 9.2 | 19.1 | 31.5 | 3104 | 8251 | 6702 | 161.8 | 115.9 | 54.1 |
| 75/9150/29 | 9.2 | 19.2 | 31.7 | 3175 | 8259 | 6746 | 161.7 | 115.5 | 54.2 |
| 75/9150/58 | 9.3 | 19.3 | 31.7 | 3062 | 8185 | 6737 | 161.9 | 115.4 | 54.2 |
| 50/9150/58 | 9.5 | 19.7 | 32.1 | 2933 | 7695 | 6469 | 158.5 | 115.3 | 54.4 |
| 50/9150/29 | 9.6 | 19.7 | 32.2 | 2984 | 7720 | 6518 | 159.7 | 115.3 | 54.3 |
| 50/9150/0 | 9.7 | 20.0 | 32.4 | 2946 | 7570 | 6460 | 159.1 | 115.3 | 54.3 |

TABLE 4-continued

| Ball | Launch Angle (°) | | | Spin Rate (rpm) | | | Initial Velocity (ft/s) | | |
|---|---|---|---|---|---|---|---|---|---|
| | D[1] | I[2] | W[3] | D | I | W | D | I | W |
| 50/8150/0 | 9.9 | 20.1 | 32.6 | 2786 | 7475 | 6351 | 159.1 | 115.3 | 54.3 |
| 50/8150/29 | 9.8 | 19.9 | 32.5 | 2928 | 7597 | 6356 | 159.0 | 115.4 | 54.3 |

[1]Standard Driver;
[2]#8 Iron;
[3]Half Wedge

Table 5 below further shows the flight of Samples A–J off the standard driver as compared to conventional golf balls like Pro V1 and Pinnacle® Gold LS. Variables listed here include trajectory, carry distance, roll distance, total distance, lateral Distance, and landing area. Five out of the ten samples out-performed Pro V1 in carry distance (up to about 4 yards), while seven out of the ten samples out-performed Pro V1 in total distance (over 4 yards).

TABLE 5

| Ball | Trajectory | Carry Distance (yd) | Roll Distance (yd) | Total Distance (yd) | Lateral Distance (yd) | Landing Area ($yd^2$) |
|---|---|---|---|---|---|---|
| Pinnacle Gold LS | 1.5 | 263.0 | 5.6 | 268.6 | 7.6 | 467 |
| Pro V1 | 2.5 | 261.9 | 2.9 | 264.8 | 1.8 | 227 |
| 75/8150/0 | 1.7 | 265.6 | 3.4 | 269.0 | 1.9 | 341 |
| 75/8150/29 | 1.6 | 262.2 | 3.5 | 265.7 | 4.8 | 292 |
| 75/8150/58 | 1.9 | 264.1 | 3.8 | 267.9 | 2.2 | 150 |
| 75/9150/29 | 2.4 | 262.6 | 3.1 | 265.7 | 2.9 | 222 |
| 75/9150/58 | 2.3 | 263.5 | 3.2 | 266.6 | 2.9 | 322 |
| 50/9150/58 | 0.3 | 258.4 | 5.1 | 263.5 | 6.8 | 247 |
| 50/9150/29 | 1.0 | 259.0 | 3.8 | 262.8 | 3.4 | 172 |
| 50/9150/0 | 0.4 | 260.7 | 4.9 | 265.6 | 3.7 | 189 |
| 50/8150/0 | 0.6 | 259.8 | 5.2 | 265.0 | 5.7 | 189 |
| 50/8150/29 | 1.1 | 260.1 | 4.6 | 264.7 | 4.9 | 285 |

All patents and patent applications cited in the foregoing text are expressly incorporated herein by reference in their entirety.

The invention described and claimed herein is not to be limited in scope by the specific embodiments herein disclosed, since these embodiments are intended solely as illustrations of several aspects of the invention. Any equivalent embodiments and various modifications apparent to those skilled in the art are intended to be within the scope of this invention. Such modifications are also intended to fall within the scope of the appended claims.

What is claimed is:

1. A golf ball, comprising:

a core;

a cover; and an intermediate layer having a thickness of less than about 0.025 inches, disposed between the core and the cover, formed from a composition comprising a high-acid ionomer comprising at least about 16% by weight of a carboxylic acid;

wherein the composition has a flexural modulus of at least 80,000 psi and a melt flow rate of about 10 g/10-min to about 100 g/10-min.

2. The golf ball of claim 1, wherein the high-acid ionomer has a melt flow rate of at least about 4 g/10-min, and wherein the carboxylic acid is neutralized by at least about 10% with a metal cation.

3. The golf ball of claim 1, wherein the composition has a material hardness of at least about 65 Shore D.

4. The golf ball of claim 3, wherein the material hardness is at least about 70 Shore D.

5. The golf ball of claim 1, wherein the intermediate layer has an on-ball hardness of less than about 70 Shore D.

6. The golf ball of claim 5, wherein the on-ball hardness is less than about 65 Shore D.

7. The golf ball of claim 1, wherein the thickness of the intermediate layer is from about 0.015 inches.

8. The golf ball of claim 1, wherein the composition further comprises a modulus-enhancing filler such that the flexural modulus of the composition with the filler is substantially greater than without the filler.

9. The golf ball of claim 8, wherein the modulus-enhancing filler comprises fibers, filaments, flakes, whiskers, wires, tubes, or particulates of nano-scale or micro-scale.

10. The golf ball of claim 1, wherein the core has a diameter of at least about 1.55 inches.

11. A golf ball, comprising:

a core;

a cover; and an intermediate layer having a thickness of from about 0.005 inches to about 0.02 inches, disposed between the core and the cover, formed from a composition comprising a blend of a first and a second high-acid ionomers each having a carboxylic acid content of at least about 16% by weight and a melt flow rate of at least about 4 g/10-min;

wherein the composition has a flexural modulus of at least about 85,000 psi and a melt flow rate of about 10 g/10-min to about 100 g/10-min.

12. The golf ball of claim 11, wherein the first and second high-acid ionomers are neutralized by about 30% to about 100% and have a weight ratio of from about 5:95 to about 95:5.

13. The golf ball of claim 11, wherein the composition has a material hardness of at least about 65 Shore D, and wherein the intermediate layer has an on-ball hardness of no greater than about 70 Shore D.

14. The golf ball of claim 13, wherein the material hardness is at least about 70 Shore D, and the on-ball hardness is no greater than about 65 Shore D.

15. The golf ball of claim 11, wherein the composition further comprises a modulus-enhancing filler such that the flexural modulus of the composition with the filler is substantially greater than without the filler.

16. A golf ball, comprising:

a core;

a cover; and an intermediate layer having a thickness of from about 0.005 inches to about 0.02 inches disposed between the core and the cover, formed from a composition comprising at least one high-acid ionomer comprising at least about 16% by weight of a carboxylic acid, wherein the composition has a flexural modulus of at least 80,000 psi and a melt flow rate of about 10 g/10-min to about 100 g/10-min.

17. The golf ball of claim 16, wherein the composition further comprises at least a second high-acid ionomer comprising at least about 16% by weight of a carboxylic acid and having a melt flow rate of at least about 4 g/10-min.

18. The golf ball of claim 16, wherein the composition further comprises at least one material chosen from ionomers having a melt flow rate of less than about 4 g/10-min and non-ionomeric materials.

19. The golf ball of claim 18, wherein the non-ionomeric material comprises at least one material chosen from thermoplastic elastomers, non-ionomeric olefin/acid copolymers or terpolymers, polyamides, polyolefins, polyurethanes, polyureas, epoxies, polyesters, polyetheresters, polyetheramides, polyamides, metallocene-catalyzed polymers, functionalized styrene-butadiene elastomers, -styrenic block copolymers, acrylonitrile-butadiene-styrene copolymers, and silicone.

20. The golf ball of claim 18, wherein the non-ionomeric material has a carboxylic acid content of about 5% to about 30% by weight.

* * * * *